United States Patent [19]

Hopper

[11] Patent Number: 4,760,811

[45] Date of Patent: Aug. 2, 1988

[54] FRP (FIBER REINFORCED PLASTIC) TRANSOM REINFORCEMENT

[76] Inventor: Randy W. Hopper, Rte. A, Box 188, Flippin, Ark. 72634

[21] Appl. No.: 30,383

[22] Filed: Mar. 26, 1987

[51] Int. Cl.[4] ..... B63B 5/24

[52] U.S. Cl. ..... 114/65 R; 114/357

[58] Field of Search ..... 114/56, 57, 355, 356, 114/357, 358, 65 R; 440/49

[56] References Cited

U.S. PATENT DOCUMENTS

| | | | |
|---|---|---|---|
| 3,080,267 | 3/1963 | Schmalz | 114/357 |
| 3,093,847 | 6/1963 | Strecker | 114/357 |
| 3,124,813 | 3/1964 | Graef | 114/357 |
| 3,831,212 | 8/1974 | Moore et al. | 114/357 |
| 4,099,280 | 7/1978 | Hoppe et al. | 114/357 |

*Primary Examiner*—Joseph F. Peters, Jr.
*Assistant Examiner*—Stephen P. Avila
*Attorney, Agent, or Firm*—Colton & Stone, Inc.

[57] ABSTRACT

A fiber reinforced plastic having the high fiber to resin ratio associated with pultruded parts is employed as a boat transom reinforcement.

9 Claims, 2 Drawing Sheets

FIG. 1
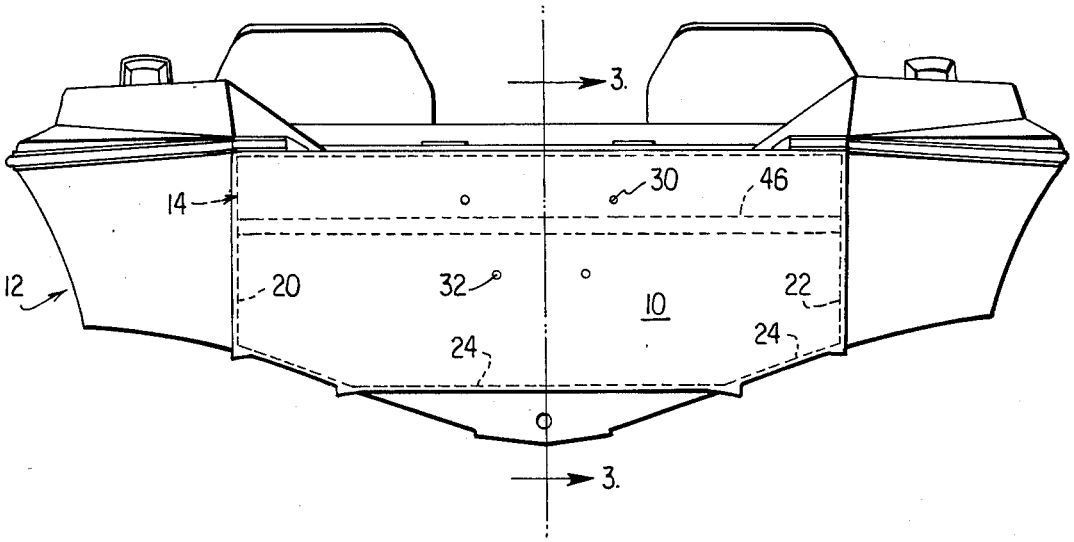
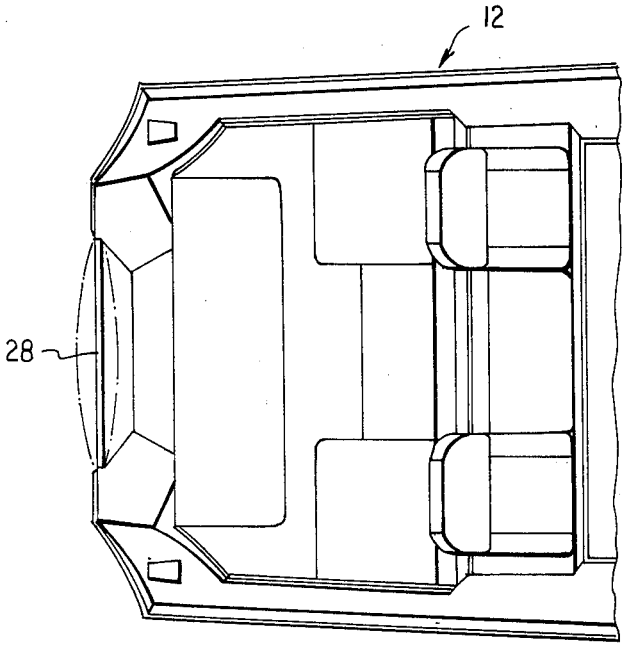
FIG. 2

FRP (FIBER REINFORCED PLASTIC) TRANSOM REINFORCEMENT

BACKGROUND OF THE INVENTION

The invention is directed to fiberglass power boats of the type propelled by transom mounted, outboard propulsion units; and more specifically to a transom reinforcement therefor.

Transom mounted propulsion units, and particularly those rated at 150 horsepower and above, impose severe structural stresses on the transom both as a function of their own weight (upwards of 400–450 pounds) and the changing torques applied to the transom propulsion unit transmits its thrust to the boat via the transom at varying speeds from start-up to more than 75 miles per hour.

The relatively long, upper transom edge spanning the splash well is particularly vulnerable to transverse flexure as thrust variations are transmitted thereto via the centrally mounted propulsion unit which is, essentially, "hung" from adjacent the upper edge thereof via its upper mounting holes. Similarly, the striking of underwater obstacles such as stumps or the like impose high impact torques which are transmitted to the upper transom edge. Those transverse flexural stresses that can be absorbed by the transom are transferred to the hull sides at opposite ends of the transom reinforcement frequently resulting, after long term use, in fracture at the splash well corners. In the case of violent impacts, such as by an underwater obstacle, the transom fractures centrally and the propulsion unit is literally torn from its lower mounting holes.

Fiberglass power boat transoms are, conventionally, reinforced by fiberglass encased plywood; the plywood being designed to provide structural strength for propulsion unit support and sufficient flexibility to absorb normal propulsion unit induced vibrations without fracturing. The thickness of the plywood reinforcement may vary from less than an inch to upwards of two inches depending, primarily, on the weight and horsepower rating of the propulsion unit to be supported. A secondary consideration in the choice of plywood thickness is a natural tendency to "overbuild" the engineering design to compensate for known variants in wood strengths as among different lots. Major disadvantages in the use of plywood reinforcements are the inherent weakness of the material in resisting transverse flexion and its susceptibility to rot; each of these disadvantages, after prolonged use, becoming more pronounced as a function of the other.

Although the conventional plywood transom reinforcement is encased in fiberglass, the transom is traversed by a number of through holes exposing the plywood. These through holes necessarily include the propulsion unit mounting holes and, optionally, drain and/or live well openings. The through holes provide moisture ingress paths that can rot the plywood when the through hole seals are defective or become defective through use. Exemplary of the latter is vibration induced seal displacement which, in turn, is a function of the weight, horsepower and use conditions of the supported propulsion unit producing transverse transom flexure. The problem of transom rot has increased in recent years as manufacturers have upped horsepower ratings to mcet consumer demand for higher performance which, in turn, increases the liklihood of transom fracture even under conservative operating conditions after the transom reinforcement has begun to rot.

The primary object of the invention is to provide a unit handled subassembly constituting a transom reinforcement that can be assembled and glassed as readily as a plywood reinforcement but which is many times stronger than wood and not susceptible to rot.

SUMMARY OF THE INVENTION

The invention introduces a new concept in fiberglass boat construction; that of the pultruded fiber reinforced plastic (FRP) transom reinforcement. For purposes of the present disclosure, the pultruded FRP transom reinforcement will be described as fiberglass without intention of limiting the disclosure breadth to exclude other reinforcing fibers.

As is well understood, the strength characteristics of fiberglass are primarily determined by its glass content since the resin binding the fibers together is, itself, readily fracturable until it is reinforced by glass or other fibers. In the case of fiberglass power boats of the type with which the invention is concerned, a glass to resin weight ratio of 20–35/80–65 is typically employed in spray-up or hand lay-up of the boat hulls which are the only feasible methods of achieving the required, compound hull curvatures. Higher glass to resin ratios than about 35/65 in spray-up or hand lay-up techniques exhibit insufficient resin bonding with the fibers. The 20–35/80–65 ratio provides adequate outer hull strength except at the transom which, as previously explained, requires additional reinforcement.

Through standard pultrusion techniques glass to resin weight ratios upwards of 75/25 may be achieved with adequate bonding among the fibers as a function of the pultrusion method which consists of drawing continuous strands of preimpregnated fibers through a heated steel die of the desired cross-section. Since the flexural modulus of fiberglass is an exponential function of glass content and the compressive modulus a linear function thereof; it is apparent that the structural strength, and particularly resistance to transverse flexure, of a pultruded fiberglass part greatly exceeds that of a hand lay-up or spray-up part and is more than ten times as strong a plywood of equal thickness.

The transom reinforcement herein disclosed consists of a unit handled subassembly made up of two pultruded parts; one part, reinforcing the upper portion of the transom through which the upper propulsion unit mounting holes extend, being anisotropic having been pulled with all parallel fiber orientation and the other part being isotropic having been pulled with woven and/or continuous strand mat. The purpose of the upper anisotropic part is to provide maximum flexion resistance at the transom area most vulnerable to vibration since the anisotropic part exhibits even more than an exponential increase in flex modulus versus glass content due to the all parallel fiber orientation. Furthermore, the anisotropic part is pulled in channel section to further increase flex resistance. The isotropic part is interfitted with the channel section of the anisotropic part and constitutes the remainder or lower portion of the transom reinforcement area which is virtually isolated from flexion stresses by being hull supported on three sides and "capped" by the anisotropic part. Thus freed from unusual flexion stresses, the lower transom reinforcement area is isotropic to provide the increased strength inherent in a pultruded part to withstand stresses in all directions.

Since the glass to resin ratio can be precisely controlled in a pultruded part each pultruded transom reinforcement of the same dimensions will have the same structural characteristics making it unnecessary to "overbuild" design parameters which may be kept relatively thin as compared with plywood.

DESCRIPTION OF THE DRAWINGS

FIG. 1 is a rear elevation of a fiberglass power boat of the type propelled by an outboard propulsion unit;

FIG. 2 is a top plan view of the aft end of the power boat; and

DESCRIPTION OF THE PREFERRED EMBODIMENT

Figure 3:
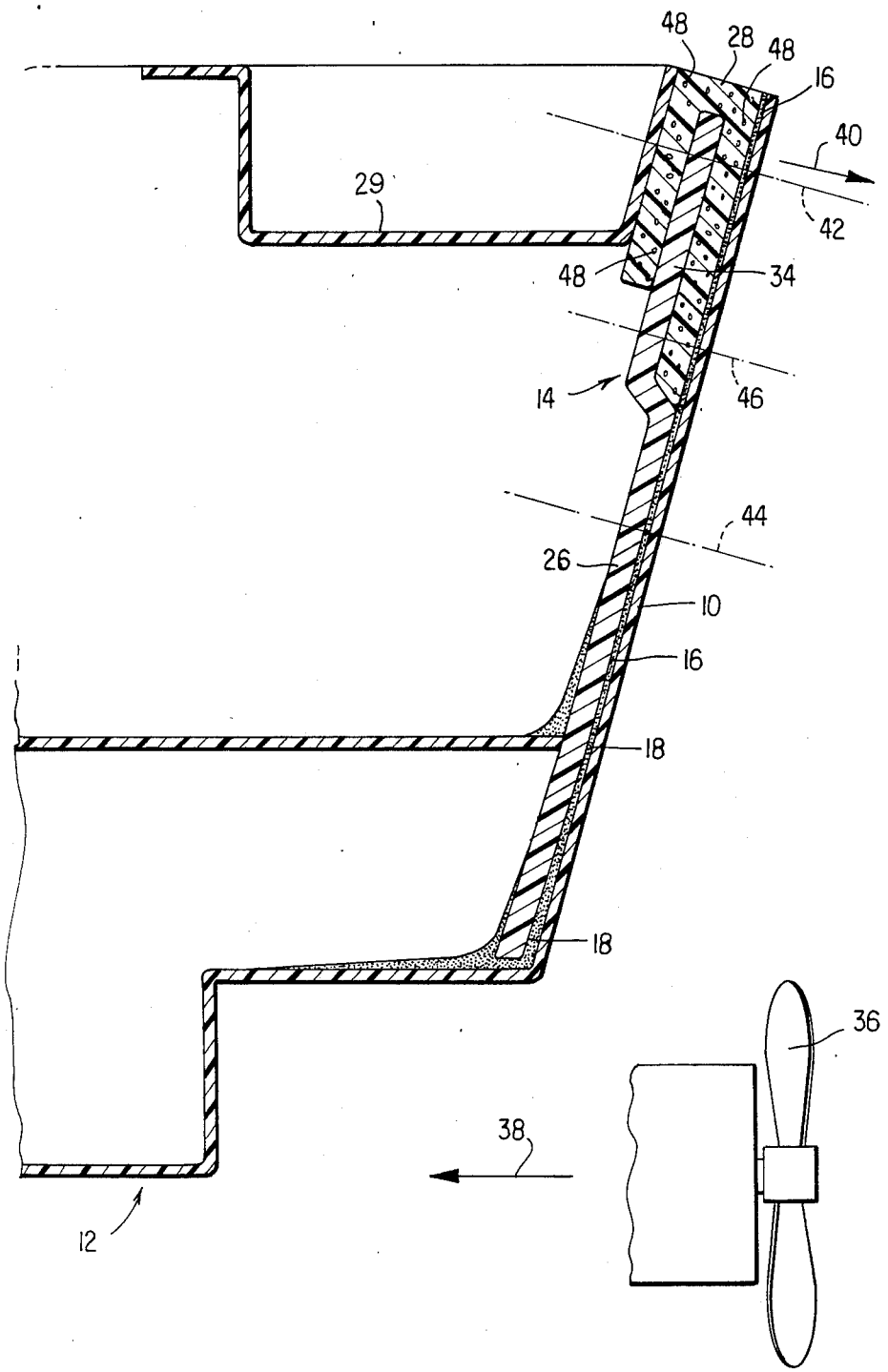
FIG. 3 is a sectional view taken along line 3—3 of FIG. 1 and additionally illustrating the propeller position when an outboard propulsion unit is bolted to the power boat.

The transom 10 of a fiberglass power boat 12 is reinforced by a unit handled, reinforcement subassembly 14 exhibiting a generally rectangular shape as depicted by the phantom showing in aft end elevation (FIG. 1). The aft face surface 16 of subassembly 14 is glassed to transom 10 as indicated at 18 (FIG. 3) and further glassed to the hull along side edges 20, 22 and lower edge 24 (FIG. 1).

Subassembly 14 consists of two interfitted, pultruded parts (FIG. 3); a lower isotropic part 26 interfitted with, and capped by, a channel shaped anisotropic part 28 comprising the upper area and the upper, or fourth, edge of subassembly 14 spanning splash well 29.

Transom 10 and reinforcement 14 are pierced by upper and lower propulsion unit mounting holes 30, 32 (FIG. 1); upper holes 30 extending through the channel portion of anisotropic part 28 as well as the upper, interfitted portion 34 of isotropic part 26. Lower mounting holes 32 transverse only the isotropic part 26.

With a propulsion unit bolted to transom 10 and propeller 36 delivering varying forward thrust loads 38 to the transom via bolt holes 30, 32, the upper area of the transom, and particularly the upper edge, is subject to varying transverse flexion loadings 40 which are maximal at the midpoint of the upper transom edge spanning splash well 29 as a consequence of the see-saw effect of upper and lower bolt hole lines 42, 44 about axis 46 (FIG. 3)

Under normal running conditions the amplitude of the aft transverse deflections exceed those in the forward direction as schematically indicated by the exaggerated phantom depiction in FIG. 2. The reverse is, of course, true when the propulsion unit strikes a submerged obstacle. Anisotropic part 28 is pultruded with a parallel fiber orientation 48 and a glass to resin ratio of at least 60/40 and preferably 70–75/30–25 to provide maximum resistance to transverse deflection from a material standpoint, per se; and, further, formed in channel section for transverse rigidity as a function of shape.

Isotropic part 26 is pultruded with a random continuous fiber orientation (woven and/or continuous strand mat) and a glass to resin ratio of at least 60/40 and preferably 70–75/30–25 for omnidirectional transom reinforcement throughout the remainder of the transom which is less subject to transverse deflection than is the upper area thereof.

In actual tests of the reinforcement herein disclosed maximum amplitude deflections, as illustrated by the phantom lines in FIG. 2, were greatly reduced as compared with plywood.

The components of subassembly 14 are pultruded in the manner described and then frictionally interfitted and/or bonded together to produce a unit handled reinforcement that can be handled and assembled with the transom substantially as readily as the previously used plywood reinforcements.

Since transverse flexion is significantly reduced so, too, is material fatigue at the hull sides opposite the ends of reinforcement 14 resulting in longer hull life, particularly at the splash well corners. Similarly, an ability to absorb far greater impact forces without fracturing and the fact that the structural integrity of the reinforcement cannot degrade through rot provides virtual assurance that, unlike in the past, the "weak point" of the hull, if any, will be other than the transom area.

I claim:

1. In combination with a fiber reinforced plastic boat hull of the type having a splash well and propelled by a transom mounted, outboard propulsion unit, the improvement comprising; a generally rectangular, unit handled, fiber reinforced plastic transom reinforcement side bonded to said hull on three side edges thereof, including the lower side edge, and face bonded to said transom; the upper side edge of said transom reinforcement spanning said splash well; and the fiber to resin weight ratio of said transom reinforcement being at least 60/40.

2. The combination of claim 1 wherein the upper area of said generally rectangular reinforcement, including said upper side edge, is anisotropic.

3. The combination of claim 2 wherein the fiber orientation within said upper area is parallel.

4. The combination of claim 3 wherein said transom reinforcement comprises two interfitted parts; said anisotropic, upper area comprising one of said parts and including a channel section interfitted with the other of said parts; and said other, lower part being isotropic.

5. The combination of claim 4 including upper propulsion unit mounting holes extending through said transom and said channel section; and lower propulsion unit mounting holes extending through said transom and said other, isotropic part of said transom reinforcement.

6. In combination with a fiber reinforced plastic boat hull of the type having a splash well and propelled by a transom mounted, outboard propulsion unit, the improvement comprising; a generally rectangular, unit handled, fiber reinforced plastic subassembly reinforcing said transom; said subassembly bonded to said hull along three side edges, including the lower side edge, and bonded to said transom along a generally rectangular face thereof; and at least the upper area of said subassembly, including the upper edge thereof, comprising a parallel fiber orientation in a fiber to resin weight ratio of at least 60/40.

7. A method of reinforcing a power boat transom with an all fiber reinforced plastic reinforcement, comprising; pultruding and cutting to desired length a first fiber reinforced plastic shape having a fiber to resin weight ratio of at least 60/40; pultruding and cutting to desired length a second fiber reinforced plastic shape having a fiber to resin weight ratio of at least 60/40; joining said first and second shapes and forming a generally rectangular subassembly, as viewed in elevation; and bonding said subassembly to a power boat transom to reinforce the same.

8. The method of claim 7 including the step of pultruding said first fiber reinforced plastic shape with all parallel fiber orientation; pultruding said second fiber reinforced plastic shape with continuous, non parallel, orientation; forming said generally rectangular subassembly with said first fiber reinforced plastic shape extending the length thereof at one long side edge; and bonding said subassembly to a power boat transom with said one long side edge spanning the power boat splash well.

9. The method of claim 8 including the step of pultruding said first fiber reinforced plastic shape in channel section; said channel section comprising said one long side edge; and the joining of said first and second fiber reinforced plastic shapes includes the step of interfitting said second shape with said channel section.

* * * * *